United States Patent [19]

de Barbadillo, II

[11] 4,121,924

[45] Oct. 24, 1978

[54] ALLOY FOR RARE EARTH TREATMENT OF MOLTEN METALS AND METHOD

[75] Inventor: John Joseph de Barbadillo, II, Warwick, N.Y.

[73] Assignee: The International Nickel Company, Inc., New York, N.Y.

[21] Appl. No.: 723,886

[22] Filed: Sep. 16, 1976

[51] Int. Cl.[2] ..... C22C 33/06

[52] U.S. Cl. ..... 75/129; 75/122; 75/123 E; 75/134 F; 75/152; 75/170; 148/31; 148/32

[58] Field of Search ..... 75/134 F, 123 E, 129, 75/152, 170, 122; 148/31, 32

[56] References Cited

U.S. PATENT DOCUMENTS

| | | | |
|---|---|---|---|
| 2,771,359 | 11/1956 | Morana | 75/152 X |
| 2,810,640 | 10/1957 | Bolkcom et al. | 75/152 X |
| 2,829,973 | 4/1958 | Jessup | 75/152 X |
| 2,841,488 | 7/1958 | Morrogh | 75/123 CB |
| 2,850,381 | 9/1958 | Bolkcom et al. | 75/152 X |
| 3,189,445 | 6/1965 | Calkins et al. | 75/170 |
| 3,801,311 | 4/1974 | Church et al. | 75/152 X |
| 3,894,867 | 7/1975 | Fishman et al. | 75/123 E |
| 3,949,351 | 4/1976 | Clark et al. | 75/152 X |
| 3,980,468 | 9/1976 | Rosof et al. | 75/152 X |

FOREIGN PATENT DOCUMENTS

| | | | |
|---|---|---|---|
| 1,181,430 | 1/1964 | Fed. Rep. of Germany | 75/152 |
| 16,210 of | 1909 | United Kingdom | 75/152 |
| 16,853 of | 1903 | United Kingdom | 75/152 |

*Primary Examiner*—R. Dean

*Attorney, Agent, or Firm*—Raymond J. Kenny; Ewan C. MacQueen

[57] ABSTRACT

Alloy containing special ternary proportions of nickel, iron and rare earths of group cerium, lanthanum, neodymium and praseodymium has density, melting temperature, toughness, stability and other characteristics specially beneficial for production and use as addition agent in rare earth treatment of molten iron-group metals, particularly including steels and nickel-base alloys.

14 Claims, 1 Drawing Figure

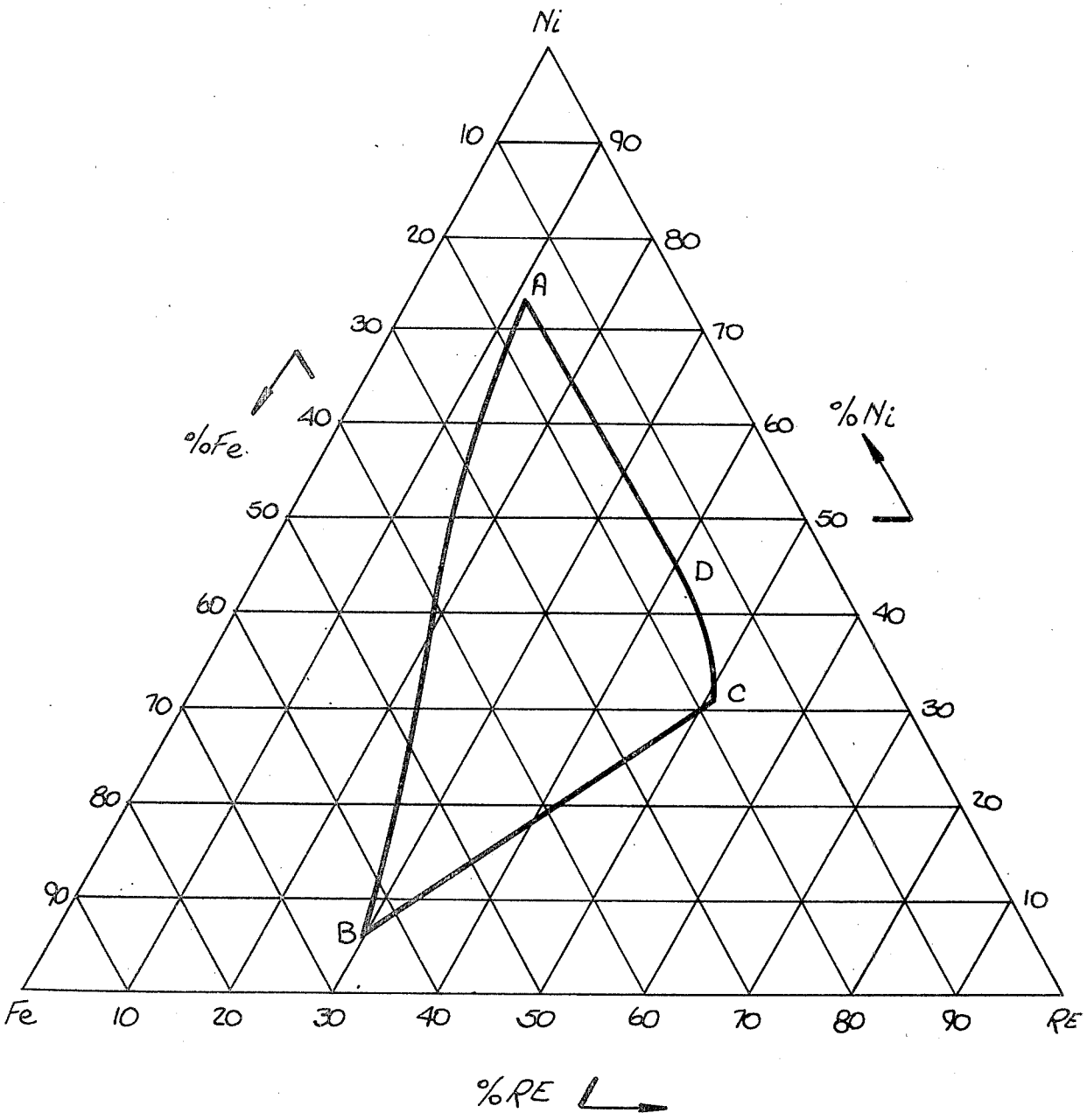
Ni
10
90
20
80
30
70
40
60
50
50
60
40
70
30
80
20
90
10
A
B
C
D
%Fe
%Ni
Fe
10
20
30
40
50
60
70
80
90
RE
%RE

ALLOY FOR RARE EARTH TREATMENT OF MOLTEN METALS AND METHOD

The present invention relates to metallurgy and more particularly to the addition of rare earth elements to molten metals.

Heretofore, it has been proposed to treat molten metals with small amounts of one or more of the "light" rare earth metals cerium, lanthanum, meodymium and praseodymium, sometimes as mischmetal, for purposes of enhancing the solidified alloy characteristics, for instance, for controlling the shapes of sulfide inclusions in alloy steels, or for improving the oxidation resistance of nickel-chromium alloys. While some success has been achieved with laboratory melts, difficulties are encountered in achieving satisfactory efficiency and control, and economy, in efforts at processes to add very small proportions, e.g., 0.03%, of rare earth elements to large heats made on a commercial scale. There have been needs for a rare earth metal addition process and agent having utility characteristics desirable for success in commercial production and use of the agent.

There has now been discovered a rare earth metal-containing alloy having special qualities of utility including, among others, satisfactory density and durability in the solid condition and good dispersibility and miscibility in the liquid condition, for use as an addition agent to add rare earth metal elements to molten heats of high melting temperature metals such as steels, nickel-base alloys and other alloys characterized by melting points (or ranges) about 2500° F. or higher, e.g., 2800° F.

An object of the invention is to provide an addition agent for incorporating rare earth metal elements into steels, nickel-base alloys or other metals having melting temperature and density characteristics in the ranges thereof or higher.

It is also an object of the invention to provide a process for incorporating rare earth metals into steels and other high melting temperature metals.

Other objects and advantages of the invention will become apparent from the following description taken in conjunction with the accompanying drawing showing a triaxial diagram referring to weight percentages of iron, nickel and certain rare earth metals of the group cerium, lanthanum, neodymium and praseodymium and mixtures thereof (referred to as RE percents).

The present invention contemplates a nickel-iron-rare earth metal alloy containing, by weight, a total of at least about 90%, advantageously 95% or more of nickel, iron and rare earth metal from the group referred to herein as RE consisting of cerium, lanthanum, neodymium, praseodymium and mixtures thereof in proportions correlated to each other in accordance with ternary percentages in the area encompassed by line ABCDA of the accompanying drawing. Area ABCDA includes the ternary percentages points enclosed within, and those on, a continuous line passing through points A, B, C, and D in succession, and returning to A, having the ternary percentage coordinates set forth in the following table wherein the amount of each element present is referred to individually as the percentage of the total weight of nickel, iron and RE metal present in the alloy, computed exclusively of any other elements that may also be present.

| | Ternary Percentages (by Total Weight Ni, Fe & RE) | | |
|---|---|---|---|
| | Ni | Fe | RE |
| A | 73 | 15 | 12 |
| B | 6 | 64 | 30 |
| C | 31 | 18 | 51 |
| D | 40 | 15 | 45 |

It is to be understood, accordingly, that the alloy has ternary proportions of 6% to 73% nickel, 15% to 64% iron and 12% to 51% RE based on the total nickel, iron and RE weight content, which is at least 90% of the alloy. Further, inasmuch as the alloy may include other desired or nondetrimental elements in amounts totaling up to 10% of the alloy, for instance, magnesium contents up to 4% can be beneficial, embodiments of the alloy can have percentages of nickel, iron and rare earth metal in ranges of about 5.5% to 73% nickel, 13.5% to 64% iron and 11% to 51% rare earths based on the total weight of all elements present.

The invention further contemplates treatment of a molten bath of a high melting temperature iron-group metal containing a major proportion of iron-group metal from the group iron, nickel, cobalt and mixtures thereof characterized by melting temperatures of about 2000° F. or higher with a process comprising establishing a molten bath of the iron-group metal at a treatment temperature of about 2100° F. or higher, preferably not above 3100° F., introduing into the molten bath, e.g., by dropping onto the surface of the bath, a previously solidified addition-agent alloy containing 90% or more nickel, iron and rare earth metal in ternary proportions according to area ABCDA of the accompanying drawing and possibly containing up to 4% magnesium, advantageously 2% to 3% magnesium, while the bath is at the treatment temperature and maintaining the bath with the added agent therein at about the treatment temperature for a time sufficient for dispersing, by melting, dissolving or other alloying action, the agent alloy throughout the bath. If desired, the bath can be stirred to hasten dispersion. Advantageously, the addition agent is provided in configurations of about 1-inch diameter or thickness, or larger, e.g., 4-inch diameter, to aid retention and dispersion in the bath. After introduction and dispersion of the agent, the bath is tapped, with or without further deoxidation or other treatment according to melting practice desired for the particular metal of the bath, into a ladle for casting in molds, or may be cast directly from the bath, and is ultimately solidified to form ingots or other desired cast forms. The treatment can be used on baths melted in air or vacuum, by induction or arc melting, or with other melt practices known for melting high melting temperature iron-group alloys.

Compositional control of the Ni/Fe/RE addition agent alloy in accordance with the alloy composition of the invention provides for achieving desirable dispersibility and durability characteristics that benefit production and utility of the alloy as an agent for incorporating rare earth metals reliably and efficiently, and economically, into molten heats of high melting temperature metals such as steels and nickel-base or cobalt base alloys. The alloy has good melting and castability characteristics that enable the alloy to be prepared satisfactorily by air-induction melt practices and the alloy has good fluidity and solidification characteristics, including resistance to hot cracking, for production of sound dense castings, e.g., ingots cast in iron molds for desired sizes and forms of additions to melts.

Sound castings of the alloy have density and melting temperature characteristics of about 7.3 to 8.5 actual density (density of the as-cast condition) and about 2000° F. to 2500° F. melting temperature (temperature at which the alloy is entirely molten) that benefit dispersibility of the addition agent.

Durability, which includes endurance in desired forms during handling, shipping and storing for long times at ordinary temperatures, of the addition agent is benefited by metallurgical stability and ductility characteristics of the alloy, for instance, the cast alloy is resistant to impact fracture if the castings are dumped several feet or more, e.g., 5 feet onto a concrete floor, and during storage is resistant to flaking, crumbling and other decrepitation or disintegration, e.g., the decrepitation of rare earth-nickel alloys after solidification.

Calcium would be detrimental in the alloy of the invention and, if tending to be picked-up from raw materials, should be restricted to amounts not exceeding 0.1%, desirably not more than 0.08% or less, e.g., 0.05% calcium, of the solidified addition alloy. The alloy has desirable, although limited, tolerance for other elements frequently occurring as impurities or alloying elements in recycled scrap of steels or other iron-group metals and thus the addition agent alloy may contain as much as 5% or 10% in total of elements other than nickel, iron and rare earth metals, provided of course that the other elements are not in amounts so great as to overcome the good characteristics, particularly the good dispersibility and durability, of the addition alloy or be detrimental to the intended rare-earth metal addition benefits or the desired characteristics of the iron-group metal in which the addition is made. Generally, carbon, silicon and manganese in amounts up to 2% carbon, 5% silicon and 5% manganese are tolerable in the addition alloy and many embodiments will contain 0.1% to 0.25% carbon, 0.1% to 0.5% manganese and/or 0.1% to 0.5% silicon.

Oxygen and nitrogen are not desired, yet may be present, possibly as oxides and nitrides, provided restricted to proportions not exceeding in total 0.5% oxygen and nitrogen.

Presence of about 1% or more, up to 4%, advantageously 2% to 3%, magnesium in the addition alloy is beneficial for obtaining for obtaining especially desirable rapid and uniform dispersion results and can be a supplemental benefit for other desired results, e.g., sulfide shape control in steels. However, excessive amounts of magnesium can result in undesirably great, possibly explosive, reactivity during addition to molten melts of the high melting temperature alloys. Moreover, excessive magnesium is detrimental to the density and durability.

Advantageously, to ensure obtaining good dispersibility and durability characteristics, the addition alloy has a total of 65% or greater, desirably 75% or more, of nickel plus rare earth metals.

A specially restricted composition containing 15% to 25% iron, 20% to 30% rare earth metals, 2% to 3% magnesium and balance essentially nickel is particularly advantageous as an agent for a late addition to steel, e.g., in the furnace just before tapping, or into the ladle or ingot mold, and for obtaining special advantages of sulfide shape control.

Another specially restricted composition containing 15% to 25% iron, 35% to 45% rare earth metals, up to 4% magnesium and balance essentially nickel is specially advantageous as a high rare earth content additive to steels and nickel-base alloys.

The microstructure of the cast alloy is a peritectic structure having a dendritic lattice of substantial volume, at least 10% by volume, of an iron-rich nickel-iron solid solution phase that benefits the ductility essential for needed crack resistant characteristics of the structure. The nickel-iron phase, among other things, distinguishes the alloy from stoichiometric composition compounds of rare earth metals, either those included in the present addition agent or other rare earth metals, some of which are taught for use in magnets, e.g., dysprosium and the compound $DyFe_{2.5}Ni_{2.5}$. Along with the nickel-iron phase, the cast alloys of the invention had several differently etching phases that were found, by electron microprobe analyses, to be nickel-rich phases containing iron and rare earth metals in differing proportions.

To prepare additions that are fractional weights of the addition alloy ingots, the ingots are cut, e.g., by abrasive wheel or saw, to needed sizes. Although some other addition alloys are brittle and are easily fractured or crushed, the present alloy has ductile characteristics that resist fracture. Fracture resistance has advantages for maintaining the integrity of the alloy and avoiding losses of small particles and fines, such as are apt to occur in handling and shipping or by being blown out or fluxed off during addition to furnace melts.

For purposes of giving those skilled in the art a better understanding of the invention, the following examples are given.

EXAMPLE I

An air-induction melt for an alloy containing about 38% rare earth metals, 24% iron and balance essentially nickel (38%) was prepared by melting electrolytic nickel and Armco iron and adding mischmetal (of usual proportions of about 48% cerium, 33% lanthanum, 14% neodymium, 5% praseodymium) when the melt temperature reached about 2800° F. The mischmetal was added as chunks cut from a 25 mm-thick slab, this form of addition being found preferable for good recovery of the rare earth and for avoiding excessive dross. Clay/graphite crucibles were found best for resisting refractory erosion. After the mischmetal was alloyed into the nickel-iron melt, the alloy was cast in cast-iron molds for small ingots suitable as additions to large melts. The molten alloy showed good fluidity at 2500° F. Satisfactorily sound impact-resistant ingots were obtained without detrimental porosity of hot cracking. The ingots showed good durability and freedom from decrepitation during storage in a controlled humidity atmosphere in a cabinet holding the atmosphere at 98% relative humidity and 100° F. for 30 days. Results of chemical analyses (normalized to 100%) of specimens of the cast alloy (alloy 1) and of physical characteristic determinations were: chemistry-37.9% in total of the rare earth metals cerium, lanthanum, neodymium and praseodymium/23.8% iron/37.7% nickel/0.1% carbon/0.4% oxygen/0.1% silicon; as-cast density-7.82; melting temperature-about 2280° F.

Micrographic examination of a specimen of alloy 1 in the as-cast condition showed the microstructure comprised nickel-iron dendrites and three differently etching phases identified as $(Ni,Fe)_5RE$, $(Ni,Fe)_7RE_2$ and $(Ni,Fe)_3RE$.

A melt (IA) of a carbon-manganese steel containing 0.10% carbon, 1.25% manganese, 0.25% silicon, 0.01% phosphorus and 0.02% sulfur was heated to 2900° F., killed with aluminum, and treated with an addition of 0.1% rare earth metal by dropping into the melt cast portions of alloy 1 weighing about 0.25% of the steel melt. The addition alloy dispersed into the steel melt quickly and quietly without visible reaction. About 5 minutes after the addition, the steel melt was poured for solidification in a mold. Chemical analysis of the solidified steel showed the steel treated with addition of alloy 1 contained 0.026% mischmetal rare earths, 0.11% nickel, 0.007% aluminum and 0.007% oxygen. Micrographic inspection indicated the addition was helpful for sulfide shape control.

EXAMPLE II

A melt for an alloy containing about 27% rare earth metals, 21% iron and balance essentially nickel (52%) was prepared and cast, with raw materials and foundry practices of Example I, to provide ingots of alloy 2. Characteristics of cast alloy 2 were: chemistry-27.1% rare earth metals/20.8% iron/51.7% nickel/0.1% carbon/0.2% oxygen/0.1% silicon; as-cast density-8.03; melting temperature about 2300° F.

In an illustrative example, a 2000-lb (pound) melt (IIA) of a nickel-chrome alloy containing 78% nickel, 14% chromium and 7% iron is heated to 2750° F. and treated at this temperature with a 7½-lb addition of alloy 2 added by dropping an ingot of alloy 2 into the melt. The melt is held at the treatment for about 5 minutes after adding alloy 2 and is then cast and solidified in forging ingot molds to provide ingot metal having 0.05% or more rare earth metal dispersed in the solidified alloy of melt IIA. The treatment is deemed beneficial for enhancing the oxidation resistance of the nickel-chromium alloy.

EXAMPLE III

A melt for an alloy containing about 26.3% rare earth metals, 32.5% iron and balance essentially nickel (40.9%) was prepared and cast, with raw materials and foundry practices of Example I, to provide ingots of alloy 3. Characteristics of cast alloy 3 were: chemistry-26.3% rare earth metals/32.5% iron/40.9% nickel/0.1% oxygen/0.1% silicon; as-cast density-7.86; melting temperature about 2425° F.

In an illustrative example, a 2000-lb melt (IIIA) of a high-strength low-alloy steel containing 0.1% carbon, 1% manganese, 0.3% silicon, 0.5% nickel, 0.5% chromium and 0.02% sulfur is heated to 2900° F. and treated at this temperature with an addition of alloy 3 added by dropping a 7½-lb ingot of alloy 3 into the melt. The melt is held at the treatment temperature for about 5 minutes after adding alloy 3 and is then cast and solidified in forging ingot molds to provide ingot metal having 0.03% or more rare earth metal dispersed in the solidified alloy of melt IIIA.

EXAMPLE IV

An illustrative example of a magnesium-containing rare earth metal addition is a cast alloy containing 2.5% magnesium, 25% rare earth metals, 20% iron, 0.1% carbon, 0.1% oxygen, 0.1% silicon and balance nickel prepared by melting nickel and iron, adding the RE metal as mischmetal, then plunging magnesium ingot at 2600° F. and casting into cast-iron molds to provide 7½-lb. ingots of alloy 4.

A 20,000 lb. melt (IVA) of an alloy steel containing 0.1% carbon, 1% manganese, 0.3% silicon, 0.25% molybdenum and 0.03% columbium is silicon deoxidized, adjusted to 2950° F., tapped into a ladle, deoxidized with aluminum and then treated with a 75-lb. addition of alloy 4 introduced by dropping ten 7½-lb. ingots of alloy 4 into the melt. After the addition the melt is held for a period of around 10 minutes and is then cast and solidified in forging ingot molds to provide ingot metal containing 0.03% or more rare earth metals dispersed in the solidified alloy of melt IVA. The treatment benefits controlling sulfide shape to avoid formation of sulfide stringers during hot rolling.

The present invention is particularly applicable in the alloying of rare earth metals into steels and nickel-base alloys in order to achieve heretofore taught benefits of rare earth metals, such as to control the shapes of sulfide inclusions in wrought steel products or to improve the oxidation resistance of nickel alloy products used at elevated temperatures. Also, the invention is generally useful where it is desired to incorporate rare earth metals into irons and steels, e.g., cast-iron, carbon steel, low alloy steel or stainless steel, nickel-base alloys, cobalt-base alloys and other metals and alloys characterized by similar or greater densities and melting temperatures.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. An alloy consisting essentially of nickel, iron and rare earth metal from the group consisting of cerium, lanthanum, neodymium, praseodymium and mixtures thereof in amounts totaling at least 90% of the alloy and in proportions correlated to each other in a ternary percentage on area ABCDA in the triaxial ternary percentage diagram of the accompanying drawing, up to 2% carbon, up to 5% manganese and up to 5% silicon, and further characterized by the following combination of characteristics: (i) good castability in air, (ii) a density of about 7.3 or greater to promote sinking, (iii) good dispersibility promoted by a melting temperature of 2500° F. or lower, (iv) good durability by reason of the ability to resist shock, both thermal and mechanical, (v) good compatability with steel, and (vi) a peritectic microstructure having (a) a dendritic lattice of an iron-rich nickel-iron solid solution phase comprising at least 10 volume-percent of the as-cast structure together with (b) at least one nickel-rich phase containing iron and rare earth metals.

2. An alloy as set forth in claim 1 wherein the total of nickel and rare earth metal is at least 65% of the alloy.

3. An alloy as set forth in claim 1 containing 15% to 25% iron, 35% to 45% rare earth metal and balance essentially nickel.

4. An alloy as set forth in claim 1 containing 1% to 4% magnesium.

5. An alloy as set forth in claim 1 containing 15% to 25% iron, 20% to 30% rare earth metal, 2% to 3% magnesium and balance essentially nickel.

6. A process for rare-earth metal treatment of a high melting temperature iron-group metal containing a major proportion of metal from the iron-group consisting of iron, nickel, cobalt and mixtures thereof and characterized by melting temperatures of about 2000° F. or higher comprising establishing a molten bath of the iron-group metal at a treatment temperature of about 2100° F. or higher and introducing into the bath while at a temperature of at least 2100° F. a previously solidified, rare earth-containing alloy as set forth in claim 1 and maintaining the bath temperature sufficiently to result in dispersion of the rare earth metal throughout the bath.

7. A process as set forth in claim 6 wherein the bath temperature is not greater than about 3100° F. at the time the rare-earth alloy is introduced into the bath.

8. A process as set forth in claim 6 wherein the rare-earth alloy contains 1% to 4% magnesium.

9. A process as set forth in claim 6 wherein the bath metal is an iron-base alloy.

10. A process as set forth in claim 6 wherein the bath metal is a nickel-base alloy.

11. An alloy as set forth in claim 1 containing 0.1% to 0.25% carbon.

12. An alloy as set forth in claim 1 containing 0.1% to 0.5% manganese.

13. An alloy as set forth in claim 1 containing 0.1% to 0.5% silicon.

14. An alloy as set forth in claim 1 containing 0.1% to 0.25% carbon, 0.1% to 0.5% manganese and 0.1% to 0.5% silicon.

* * * * *